United States Patent [19]

Reinert

[11] Patent Number: 5,074,885

[45] Date of Patent: Dec. 24, 1991

[54] PROCESS FOR THE DYEING OF WOOL WITH ANIONIC DYES AND ULTRA-VIOLET ABSORBER AND OXIDATIVE BLEACHING FOLLOWING BY REDUCTIVE BLEACHING

[75] Inventor: Gerhard Reinert, Allschwil, Switzerland

[73] Assignee: Ciba-Geigy Corporation, Ardsley, N.Y.

[21] Appl. No.: 576,639

[22] Filed: Aug. 31, 1990

[30] Foreign Application Priority Data

Sep. 6, 1989 [CH] Switzerland ..... 3229/89

[51] Int. Cl.[5] ..... D06P 5/02; D06M 13/25

[52] U.S. Cl. ..... 8/442; 8/107; 8/110; 8/111; 8/490; 8/566; 8/570; 8/573; 8/589; 8/607; 8/917; 252/301.21; 252/301.23

[58] Field of Search ..... 8/442, 490, 107, 110, 8/111

[56] References Cited

U.S. PATENT DOCUMENTS 4,668,235 5/1987 Evans et al. ..... 8/115.58
4,698,064 10/1987 Evans et al. ..... 8/128.3
4,770,667 9/1988 Evans et al. ..... 8/128.1
4,775,386 10/1988 Reinert et al. ..... 8/442
4,831,068 5/1989 Reinert et al. ..... 8/442
4,950,304 8/1990 Reinert et al. ..... 8/566
4,964,871 10/1990 Reinert et al. ..... 8/115.59

FOREIGN PATENT DOCUMENTS 8800942 2/1988 World Int. Prop. O. .

OTHER PUBLICATIONS

J. Cegarra et al., Journal of the Society of Dyers & Colourists, 88(8), 293–296 (1988).

C. M. Carr et al., Journal of Applied Polymer Science 33(6), 2087–2095 (1987).

*Primary Examiner*—A. Lionel Clingman

*Attorney, Agent, or Firm*—George R. Dohmann; Edward McC. Roberts

[57] ABSTRACT

A process for the dyeing of wool with anionic dyes is described, wherein the wool is dyed in the presence of a UV absorber and bleached oxidatively and then bleached reductively in a new bath.

This process makes it possible to produce very bright, brilliant shades.

18 Claims, No Drawings

PROCESS FOR THE DYEING OF WOOL WITH ANIONIC DYES AND ULTRA-VIOLET ABSORBER AND OXIDATIVE BLEACHING FOLLOWING BY REDUCTIVE BLEACHING

The present invention relates to a process for the dyeing of wool to produce lightfast, very bright, brilliant shades.

In the dyeing of wool, it is often required to subject the wool material to be dyed to a bleaching process for the dyes to become fully effective.

This bleaching of wool is carried out by 2 different processes:

(a) as a two-step combination bleaching using alkaline peroxide and followed by reductive bleaching or (b) as a one-step weakly acidic peroxide bleaching with the additional use of a specific activator.

Process (a) gives the best bleaching effects (whiteness), but is very time-consuming. Process (b) is a bleaching process of short duration, which leads to less whiteness in combination with a significantly redder shade.

The bleaching effects obtained with both processes, as a rule, deteriorate under the influence of the dyeing process, since exposure to heat leads to yellowing of the fibre. This is particularly disadvantageous in the case where it is desired to produce pastel dyeings or the material must be shaded.

The object on which the present invention is based consists in providing a dyeing process for wool to achieve stable bleaching effects and to produce light and brilliant shades having good lightfastness properties.

Accordingly, the present invention relates to a process for the dyeing of wool by means of anionic dyes, which comprises dyeing the wool in the presence of a UV absorber, bleaching it oxidatively and then bleaching it reductively in a new bath.

Preferably, the dyeing process and the oxidative bleaching process are carried out in the same bath.

Suitable UV absorbers are water-soluble UV absorbers described, for example, in WO 86/03528, WO 88/00942 and in U.S. Pat. No. 4,770,667.

For example, the following compounds can be used:

a) 2-hydroxybenzophenones of the formula (1)

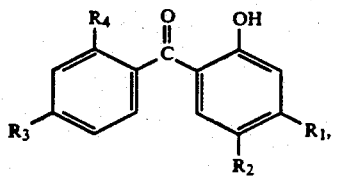

(1)

in which $R_1$ is hydrogen, hydroxyl, $C_1$–$C_{14}$alkoxy or phenoxy, $R_2$ is sulfo, $R_3$ is hydrogen, hydroxyl or $C_1$–$C_4$alkoxy and $R_4$ is hydrogen, hydroxyl or carboxyl, for example the 4-hydroxy, 4-methoxy, 4-octyloxy, 4-decyloxy, 4-dodecyloxy, 4-methoxy-2'-carboxy, 4,2',4'-trihydroxy, 4,4'-dimethoxy-2'-hydroxy, 4-methoxy-5-sulfo, 2'-hydroxy-4,4'-dimethoxy-5-sulfo, 4-benzyloxy and 5-chloro derivative;

b) 2-(2'-hydroxyphenyl)benzotriazoles of the formula (2)

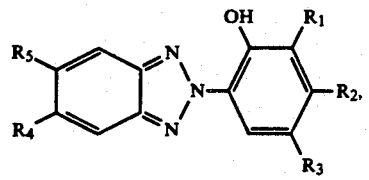

(2)

in which $R_1$ is hydrogen, chlorine, $C_1$–$C_{12}$alkyl, $C_5$–$C_6$-cycloalkyl, sulfonated $C_7$–$C_9$arylalkyl or sulfo, $R_2$ is hydrogen, chlorine, $C_1$–$C_4$alkyl, $C_1$–$C_4$alkoxy, hydroxyl or sulfo, $R_3$ is $C_1$–$C_{12}$alkyl, chlorine, $C_5$–$C_6$cycloalkyl, $C_1$–$C_4$alkoxy, phenyl, ($C_1$–$C_8$alkyl)-phenyl, $C_2$–$C_9$alkoxycarbonyl, carboxyethyl, sulfonated $C_7$–$C_9$arylalkyl or sulfo, $R_4$ is hydrogen, chlorine, $C_1$–$C_4$alkyl, $C_1$–$C_4$alkoxy, $C_2$–$C_9$alkoxycarbonyl, carboxyl or sulfo and $R_5$ is hydrogen or chlorine, and at least one of the radicals $R_3$ or $R_4$ has to be sulfo;

c) 2-(2'-hydroxyphenyl)-s-triazines of the formula (3)

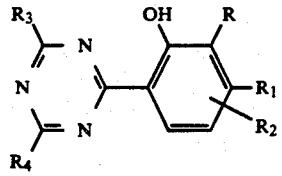

(3)

in which R is hydrogen, halogen, $C_1$–$C_4$alkyl or sulfo, $R_1$ is hydrogen, $C_1$–$C_4$alkyl, $C_1$–$C_4$alkoxy or hydroxyl, $R_2$ is sulfo and $R_3$ and $R_4$, independently of one another, are $C_1$–$C_4$alkyl, $C_1$–$C_4$alkoxy, $C_5$–$C_6$cycloalkyl, phenyl or phenyl substituted by $C_1$–$C_4$alkyl and hydroxyl, it being possible for the sulfo groups to be present in free form or in salt form, for example as alkali metal salts, alkaline earth metal salts, ammonium salts or amine salts;

d) s-triazine compounds of the formula

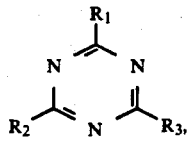

(4)

in which at least one of the substituents $R_1$, $R_2$ and $R_3$ is a radical of the formula

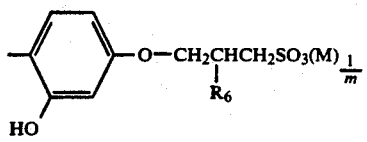

(5)

in which $R_6$ is hydrogen or hydroxyl, M is sodium, potassium, calcium, magnesium, ammonium or tetra-$C_1$–$C_4$alkylammonium and m is 1 or 2, and the remaining substituent or the remaining substituents, independently of one another, are $C_1$–$C_{12}$alkyl, phenyl, $C_1$–$C_{12}$alkyl or phenyl which is bound to the triazinyl radical via oxygen, sulfur, imino or $C_1$–$C_{11}$alkylimino, for example the potassium salt of the compound of the formula (4), in which $R_1$ is phenyl and $R_2$ and $R_3$ are each the radical of the formula (5) or the sodium salt of the compound of the formula (4) in which $R_1$ is p-chlorophenyl and $R_2$ and $R_3$ are each the radical of the formula (5). Further compounds are described in EP-A 165,608.

The compounds of the formula (1) and (2) can be prepared by processes known per se, such as are described, for example, in U.S. Pat. Nos. 3,468,938, 3,696,077 and 4,698,064.

The compounds of the formula (3) can be prepared in a manner known per se, for example by the process described in U.S. Pat. No. 4,698,064.

The UV absorber is advantageously added to the dye bath. It can be added before, during or after the dyeing stage. Thus, it is also possible to apply the UV absorber during the oxidative bleaching process.

However, it is also possible to add the UV absorber to the reductive bleaching bath.

The UV absorbers are used in an amount of 0.01 to 7.5, preferably 0.25 to 4.0 and especially 0.5 to 2.0% by weight, relative to the weight of the wool material.

For the process according to the invention, selected anionic dyes, which are known, for example, from the Colour Index, are used for the dyeing of the wool.

The anionic dyes are, for example, salts of metal-containing or metal-free mono-, dis- or polyazo dyes, including the formazan dyes and the anthraquinone, xanthene, nitro, triphenylmethane, naphthoquinoneimine and phthalocyanine dyes. The anionic character of these dyes can be caused solely by metal complex formation and/or preferably by acidic, salt-forming substituents, such as carboxyl groups, sulfuric and phosphonic ester groups, phosphono groups or sulfo groups. These dyes can also contain so-called reactive groupings in the molecule, which form a covalent bond with the material to be dyed. Acidic, metal-free dyes containing a single sulfo group or even reactive dyes preferably containing at least two sulfo groups are preferred.

It is also possible to use mixture of the anionic dyes. For example, dye mixtures of at least 2 or 3 components can be used.

The oxidative bleaching process is carried out by methods known per se and is described, for example, in Textilindustrie 67, 723f(1963) In the preferred single-bath bleaching and dyeing process according to the invention, compounds releasing active oxygen, such as performic acid, peracetic acid or in particular hydrogen peroxide are used as the bleaching agent. 35% hydrogen peroxide is preferably used. The amount used is 1 to 75 ml/l, preferably 5 to 30 m/l, relative to the wool material to be bleached. The optimum pH of this bleaching solution is 5 to 5.5 .

The oxidative bleaching agent can be used before, during or after the dyeing. Preferably, the bleaching agent is added to the dye bath immediately after the dyeing stage. This method has the advantage that products to be applied to the fibre, such as dyes, UV absorbers etc. can be applied to unbleached wool unchanged in its affinity or to prebleached wool.

The preferred single-bath dyeing and bleaching is preferably carried out by the exhaust method at liquor ratios of 5:1 to 250:1, preferably 10: 1 to 50:1% by weight. However the dyeing and bleaching can also be carried out continuously by means of low-liquor application systems or hot application systems.

The reductive bleaching process is carried out after the single-bath oxidative bleaching/dyeing process in a new bath. The reductive bleaching agent preferably used for this process is sodium bisulfite. The amounts of sodium bisulfite are between 0.25 and 10 percent by weight, in particular between 1 and 5% by weight, relative to the wool material used. The reductive bleaching process is preferably carried out in a long liquor. However, the reductive bleaching agent can in the same way be applied continuously by means of low-liquor application systems or hot application systems.

Not only the oxidative dyeing/bleaching baths but also the reductive bleaching baths can contain mineral acids, such as sulfuric acid or phosphoric acid, organic acids, advantageously lower, aliphatic carboxylic acids, such as formic, acetic or oxalic acids and/or salts, such as ammonium acetate, ammonium sulfate or sodium acetate. These compounds serve in particular to adjust the pH of the liquors, which, as a rule, is between 1.5 and 7, preferably between 3 and 5. The baths also contain commercial stabilizers and activators and can additionally contain further auxiliaries customary used in dyeing technology, for example dispersing agents, levelling agents, electrolytes, wetting agents, defoaming agents, antifoams, thickeners or wool-protecting agents.

The wool material can be present in a wide range of processing forms. Examples are as follows: loose fibre, tops, wovens, knitted goods, nonwovens, yarn or piece goods.

The process of the present invention, in which a combined dyeing/bleaching process in the presence of a UV absorber is proposed, makes it possible to produce highly lightfast, pure pastel shades.

The following examples illustrate the invention. Parts and percentages are by weight, temperatures are given in °C.

Example 1.

4 samples of a wool fabric of 10 g each are treated in an open dyeing apparatus, for example ®AHIBA, at a liquor ratio of 30:1 first at 40° for 10 minutes with 4 identical liquors, each of which contains

| | |
|---|---|
| 1 g/l of ammoniumacetate<br>3% of 80% acetic acid and<br>1% of a levelling agent | pH = 4.5 |

The treatment is carried out at this temperature for 10 minutes and the pH is again corrected with acetic acid. The samples are then removed from the liquors.

The individual samples are further treated in liquors 1–4 as follows:

Sample 1 (liquor 1): The following dyestuffs in dyestuffs in dissolved from are added to the liquor:
0.005% of the dye of the formula (I)

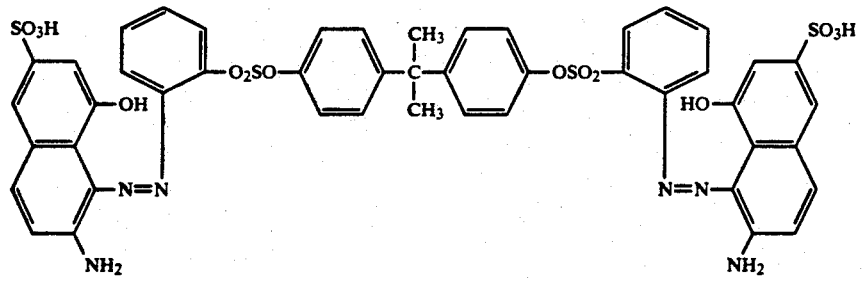

and 0.01% of the dye of the formula

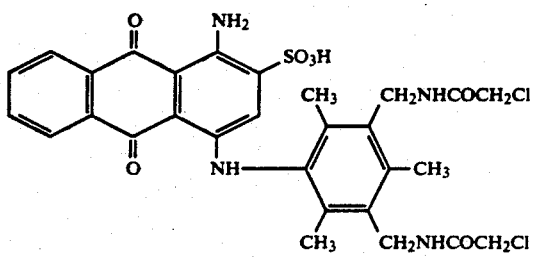

(II)

In addition, 1% of the UV absorber of the formula

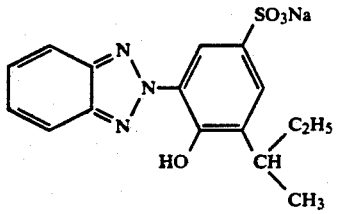

(101)

is added in dissolved form.

The sample is treated at 40° for 10 minutes, then heated at 1.5°/minute to 85° and dyed for 45 minutes. It is then cooled to 80°, and an oxidative bleaching treatment is carried out with the addition of the following compounds:

2 g/l of a stabilizer consisting of
- 43 parts of crystalline citric acid
- 46 parts of disodium phosphate and
- 11 parts of ethylenediaminetetraacetic acid sodium salt and 15 ml/l of 35% hydrogen peroxide.

Bleaching is carried out for 60 minutes with decreasing temperature. The sample is then rinsed in the cold and reductively bleached in a new bath at a liquor ratio of 30:1 at 60° for 45 minutes. The bleaching bath contains the following additives:

1.5 g/l sodium bisulfite
2% of 96% sulfuric acid.

After the treatment, the samples are rinsed with cold water, centrifuged and dried at 70° in a through-circulation oven.

Sample 2 (liquor 2): The treatment as described for sample 1 is repeated, except that sample 2 is dyed in this liquor without adding the UV absorber of the formula (101).

Sample 3 (liquor 3): The treatment as described for sample 1 is repeated, except that the treatment is discontinued after the dyeing. After the dyeing, the sample is rinsed with cold water, centrifuged and dried at 70° in a through-circulation oven.

Sample 4 (liquor 4): The treatment as described for sample 3 is repeated, except that the dyeing is carried out without adding the UV absorber of the formula (101).

All samples are then tested for lightfastness according to SN-ISO 105-BO2 (=XENON) and DIN 75.202 (=FAKRA).

The results are listed in Table 1.

TABLE 1

| Sample of | *Lightfastness values XENON | FAKRA | Note |
|---|---|---|---|
| Sample 1 | 6 | 4 | Shade: brilliant |
| Sample 2 | 4-5 | 2-3GH | violet |
| Sample 3 | 6 | 3-4GH | Shade: dull |
| Sample 4 | 5-6 | 3GH | grey-violet |

*Rating:
Xenon against blue standard
Fakra against grey standard

EXAMPLE 2

Three 10 g samples of an unbleached wool serge fabric and three 10 g samples of a wool serge fabric prebleached with an acidic prebleaching solution in combination with a reductive bleaching solution by means of sodium dithionite are prepared. They are prewetted in an open dye apparatus, for example an ®AHIBA, at a liquor ratio of 30:1. In addition, 6 identical liquors containing the following additives are prepared:

| | |
|---|---|
| 1.5 g/l of crystalline sodium acetate<br>3.0% of 80% acetic acid<br>5% of calcined Glauber salt<br>1% of a levelling agent | pH = 4.5 |

The samples of the unbleached wool are treated in liquors 1-3 and those of the prebleached wool in liquors 4-6 at 50° for 10 minutes. The pH is then corrected with acetic acid. The individual samples are further treated as follows:

Sample 1 (liquor 1): After the sample has been removed from the liquor, the following dyes in dissolved form are added:

0.005% of the dye of the formula (III)

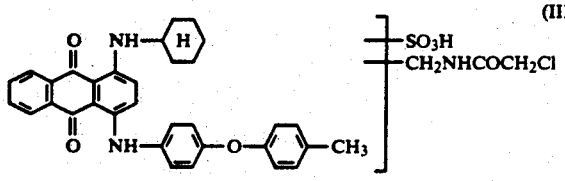

0.010% of the dye of the formula (IV)

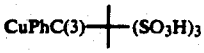

Furthermore, 1% of the compound of the formula

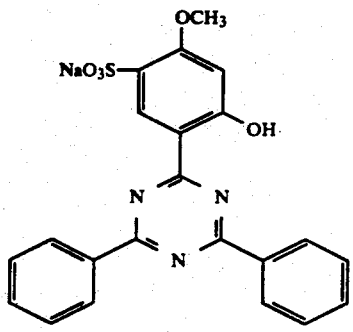

in dissolved form is added.

The sample is treated at 50° for another 10 minutes and then heated at 1.5°/minute to 95°. The treatment is carried out at this temperature for 30 minutes.

The sample is then, as described in Example 1, bleached oxidatively and reductively.

Sample 2 (liquor 2): The treatment as described for sample 1 is repeated, except that the dyeing is carried out without adding the UV absorber of the formula (102).

Sample 3 (liquor 3): The treatment as described for sample 1 is repeated, except that no dye is added to the liquor. The treatment in this liquor corresponds to a blank dyeing.

Sample 4 (liquor 4): The treatment as described for sample 1 is repeated, except that the treatment is discontinued after the dyeing. After the dyeing, the liquor is cooled to 70°, rinsed with cold water and dried at 70° in a through-circulation oven.

Sample 5 (liquor 5): The treatment as described for sample 4 is repeated, except that no UV absorber of the formula (102) is used.

Sample 6 (liquor 6): The treatment as described for sample 4 is repeated, except that no dye and no UV absorber is used. The process in this liquor corresponds to that of a blank dyeing.

TABLE 2

| | Yellow index (according to DIN 6167) | *Lightfastness according to XENON | FAKRA | Note |
|---|---|---|---|---|
| Sample 1 | — | 5-5 | 3-4GH | Shade: a trace brighter than samples 4 and 5 |
| Sample 2 | — | −5 | 3GH | |
| Sample 3 | 15.9 | — | — | |
| Sample 4 | — | 5 | −4 | Shade: a trace duller than samples 1 and 2 |
| Sample 5 | — | 4-5 | 2-3GH | |
| Sample 6 | 19.7 | — | — | |

*Rating:
Xenon against blue standard
Fakra against grey standard

EXAMPLE 3

The procedure of Example 1 is repeated, except that the following combination of dyes is used:

0.0025% of the dye of the formula (V)

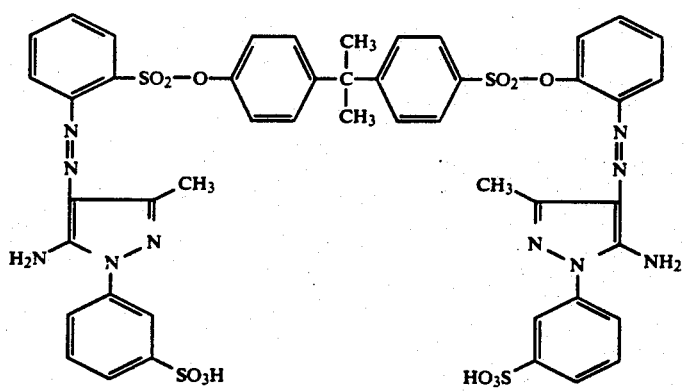

0.0100% of the dye of the formula I and
0.0025% of the dye of the formula II.

The results of the lightfastness test can be seen from Table 3.

TABLE 3

| | Lightfastness | | |
|---|---|---|---|
| | XENON* | FAKRA* | Note |
| Sample 1 | 6 | 4 | Shade: brilliant |
| Sample 2 | 4-5 | 2-3GH | light pink |
| Sample 3 | 6+ | 4 | Shade: dull |
| Sample 4 | 5-6 | 3GH | pale pink |

*Rating:
XENON against blue standard
FAKRA against grey standard

The rating of the lightfastness, shown in Tables 1-3, clearly shows that in Examples 1-3 sample 1 treated according to the invention has in each case the best lightfastness, while at the same time pure hues are obtained.

EXAMPLE 4

4 samples of a wool fabric of 10 g each are treated in an open dyeing apparatus, for example an ®AHIBA, at a liquor ratio of 30:1 and 40° for 10 minutes in dyeing liquors each containing 10% of 80% acetic acid, 5% of Glauber salt and 1% of a levelling agent. The pH is then corrected, if necessary, to the value of 5.5. The samples are then removed from the liquors and further treated as follows:

0.03% of the green dye of the formula (VI) in dissolved form is added to each bath:

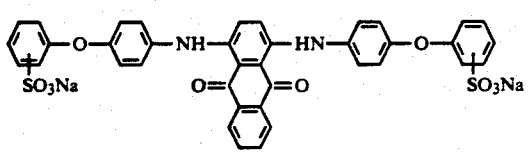

(VI)

Dyeing liquor 1 contains no further additives. 1% of the compound of the formula

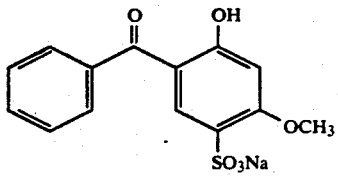

(103)

in dissolved form is added to dyeing liquor 2, 0.75% of the formula

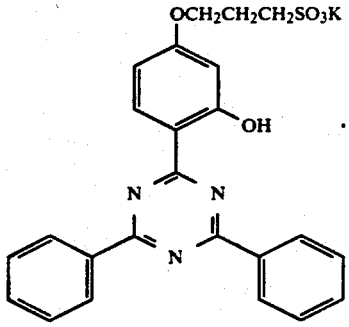

(104)

is added to dyeing liquor 3, and 0.75% of the compound of the formula

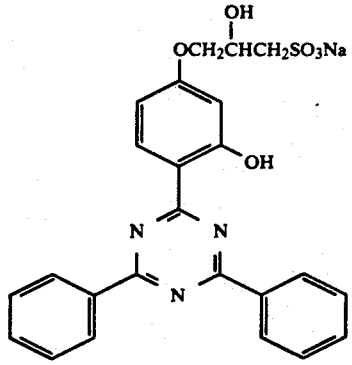

(105)

is added to dyeing liquor 4. The dyeing is carried out as described in Example 1. After the dyeing process is completed, the liquor is cooled to 70°, and 5 ml/l of a bleaching stabilizer, for example ®Prestogen W liquid (BASF) and 20 ml/l of 35% hydrogen peroxide is added, and bleaching is carried out for one hour. After the samples have been rinsed, they are, as described in Example 1, additionally bleached reductively with sodium bisulphite, rinsed with cold water, centrifuged and dried.

The lightfastness test of samples 1 to 4 in accordance with SN-ISO 105-BO2 (=XENON) gives the following results:

TABLE 4

| Dyeing No. | Lightfastness "XENON" |
|---|---|
| 1 | 4 |
| 2 | 5 |
| 3 | 5-6+ |
| 4 | 5-6 |

EXAMPLE 5

6 samples (No. 1 to 6) of a wool fabric of 10 g each are prepared. While samples 1 to 4 are still white, samples 5 and 6 are pretreated by the combination bleaching process, in which the bleaching solution has the following composition:

a. Alkaline Oxidative Bleaching Solution 15 g/l of 35% $H_2O_2$
2 g/l of tetrasodium pyrophosphate
0.5 g/l of a detergent and wetting agent The bleaching is started at a pH of 8.5 at 45° with falling temperature. The sample is kept standing overnight and then rinsed.

b. Reductive Bleaching Solution 3 g/l of stabilized sodium dithionite
0.5 g/l of a detergent and wetting agent Bleaching is carried out at 60° for 90 minutes. The sample is then rinsed, centrifuged and dried.

The individual samples are then further treated as shown below, following the procedure of Example 1.

Sample 1: Treated with 1% of the UV absorber of the formula (102) without adding a dye ("blank dyeing process").

Sample 2: Treated like sample 1 by the blank dyeing process and then treated, as described in Example 1, with an acidic oxidative bleaching solution.

Sample 3: Treated like sample 2 and then after the oxidative bleaching treatment, as described in Example 1, bleached reductively.

Sample 4: Treated like sample 3, but without adding the compound of the formula (102).

Sample 5: Treated like sample 1, but without adding the compound of the formula (102).

Sample 6: Treated like sample 1, using 0.75% of the compound of the formula (102).

All samples are then rinsed with cold water, centrifuged and dried at room temperature.

The samples are then analysed by colorimetry. On the one hand, the degree of bleaching is determined in the form of the yellow index according to DIN 6167 and, on the other hand, the amount of the compound of the formula (102) present on the fibre is determined by means of the so-called K/S values (K/S=Kubelka-Munk function). The values are determined by means of a Perkin-Elmer Lambda 9, using a 6 cm Ulbricht sphere at 698 and 280 nm. The results are listed in Table 5:

TABLE 5

| Treatment | Yellow index | K/S value |
|---|---|---|
| Sample 1 | 28.80 | 20.8 |
| Sample 2 | 21.00 | 21.5 |
| Sample 3 | 16.9 | 22.0 |
| Sample 4 | 16.1 | 3.9 |
| Sample 5 | 13.8 | 3.2 |
| Sample 6 | 14.9 | 16.6 |
| Wool, unbleached | 27.9 | 3.0 |
| Wool, prebleached | 11.3 | — |

The results show that bleaching with the acidic peroxide bleaching solution followed by bleaching with a weak reductive bleaching solution according to the process of the invention (sample 3) gives a substantially better degree of bleaching. The addition of the UV absorber of the formula (102) only causes an insignificant deterioration of the degree of bleaching (comparison of sample 3 with sample 4), while the blank dyeing process of the wool prebleached with a combination bleaching solution significantly deteriorates the degree of bleaching of the wool not only in the presence but also in the absence of the UV absorber of the formula (102) (comparison of the wool prebleached with sample 5, with that prebleached with sample 6). Upon comparison of the K/S values of samples 1-3 and sample 6, it becomes apparent that the compound (102) under comparable conditions is absorbed better by unbleached than by bleached wool, i.e. upon contact with the alkaline prebleaching solution the wool undergoes a loss in affinity.

What is claimed is:

1. A process for dyeing wool which comprises dyeing wool with an anionic dye; oxidatively bleaching the wool before, during or after the dyeing step and after the dyeing and oxidative bleaching steps are completed, in a new bath reductively bleaching the dyed wool; with the proviso that the dyeing, the oxidative bleaching or the reductive bleaching is carried out in the presence of an UV absorber.

2. A process according to claim 1, wherein the wool is dyed and bleached oxidatively in the same bath.

3. A process according to claim 1, wherein the UV absorber used is a 2-hydroxybenzophenone of the formula

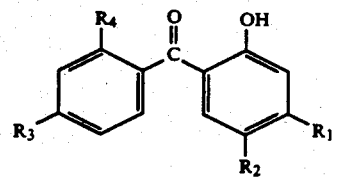

in which $R_1$ is hydrogen, hydroxyl, $C_1$–$C_{14}$alkoxy or phenoxy, $R_2$ is sulfo, $R_3$ is hydrogen, hydroxyl or $C_1$–$C_4$alkoxy and $R_4$ is hydrogen, hydroxyl or carboxyl.

4. A process according to claim 1, wherein the UV absorber used is a 2-(2'-hydroxyphenyl) benzotriazole of the formula

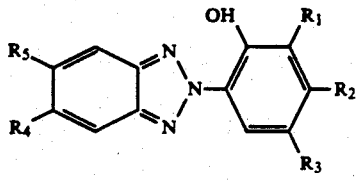

in which $R_1$ is hydrogen, chlorine, $C_1$–$C_{12}$alkyl, $C_5$–$C_6$cycloalkyl, sulfonated $C_7$–$C_9$arylalkyl or sulfo, $R_2$ is hydrogen, chlorine, $C_1$–$C_4$alkyl, $C_1$–$C_4$alkoxy, hydroxyl or sulfo, $R_3$ is $C_1$–$C_{12}$alkyl, chlorine, $C_5$–$C_6$cycloalkyl, $C_1$–$C_4$alkoxy, phenyl, ($C_1$–$C_8$alkyl)-phenyl, $C_2$–$C_9$alkoxycarbonyl, carboxyethyl, sulfonated $C_7$–$C_9$arylalkyl or sulfo, $R_4$ is hydrogen, chlorine, $C_1$–$C_4$alkyl, $C_1$–$C_4$alkoxy, $C_2$–$C_9$alkoxycarbonyl, carboxyl or sulfo and $R_5$ is hydrogen or chlorine, and at least one of the radicals $R_3$ or $R_4$ has to be sulfo.

5. A process according to claim 1, wherein the UV absorver used is a 2-(2'-hydroxyphenyl)-s-triazine of the formula

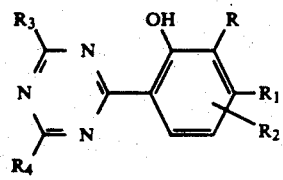

in which R is hydrogen, halogen, $C_1$–$C_4$alkyl or sulfo, $R_1$ is hydrogen, $C_1$–$C_4$alkyl, $C_1$–$C_4$alkoxy or hydroxyl, $R_2$ is sulfo and $R_3$ and $R_4$, independently of one another, are $C_1$–$C_4$alkyl, $C_1$–$C_4$alkoxy, $C_5$–$C_6$cycloalkyl, phenyl or phenyl substituted by $C_1$–$C_4$alkyl and hydroxyl.

6. A process according to claim 1, wherein the UV absorber used is an s-triazine compound of the formula

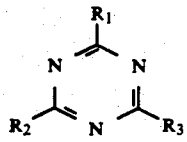

in which at least one of the substituents $R_1$, $R_2$ and $R_3$ is a radical of the formula (5)

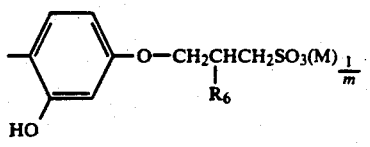

in which $R_6$ is hydrogen or hydroxyl, M is sodium, potassium, calcium, magnesium, ammonium or tetra-$C_1$–$C_4$alkylammonium and m is 1 or 2, and the remaining substituent or the remaining substituents, independently of one another, are $C_1$–$C_{12}$alkyl, phenyl, $C_1$–$C_{12}$alkyl or phenyl which is bound to the triazinyl radical via oxygen, sulfur, imino or $C_1$–$C_{11}$alkylimino.

7. A process according to claim 1, wherein the UV absorber is added to the dye bath.

8. A process according to claim 1, wherein the UV absorber is added to the reductive bleaching bath.

9. A process according to claim 1, wherein the UV absorber is used in an amount of 0.01 to 7.5% by weight, relative to the wool material.

10. A process according to claim 1, wherein the anionic dyes used are acid dyes.

11. A process according to claim 1, wherein an oxygen-releasing compound is used for the oxidative bleaching.

12. A process according to claim 11, wherein hydrogen peroxide is used for the oxidative bleaching.

13. A process according to claim 1, wherein the oxidative bleaching agent is added after the dyeing.

14. A process according to claim 1, wherein the oxidative bleaching and the dyeing are carried out by the exhaust method.

15. A process according to claim 1, wherein the reductive bleaching process is carried out with sodium bisulfite.

16. A process according to claim 15, wherein the sodium bisulfite is used in an amount of 0.25 to 10% by weight, relative to the wool material.

17. A process according to claim 1, wherein the reductive bleaching process is carried out in a long liquor.

18. The wool material treated according to claim 1.

* * * * *